US009365034B2

(12) United States Patent
Clark et al.

(10) Patent No.: US 9,365,034 B2
(45) Date of Patent: Jun. 14, 2016

(54) PRINT HEAD BIT INFORMATION MAPPING

(71) Applicant: Hewlett-Packard Development Company, L.P., Houston, TX (US)

(72) Inventors: Garrett E. Clark, Corvallis, OR (US); Christopher H. Bakker, Corvallis, OR (US); Yit Hong Tor, San Diego, CA (US); Glory J. Abadilla, Corvallis, OR (US); Andrew Phillips, Corvallis, OR (US); Glenn D. McCloy, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/771,485

(22) PCT Filed: Feb. 28, 2013

(86) PCT No.: PCT/US2013/028448

§ 371 (c)(1),
(2) Date: Aug. 28, 2015

(87) PCT Pub. No.: WO2014/133534

PCT Pub. Date: Sep. 4, 2014

(65) Prior Publication Data

US 2016/0009079 A1 Jan. 14, 2016

(51) Int. Cl.

| | |
|---|---|
| ***B41J 2/045*** | (2006.01) |
| ***B41J 29/02*** | (2006.01) |
| ***B41J 2/155*** | (2006.01) |

(52) U.S. Cl.

CPC ..... *B41J 2/04541* (2013.01); *B41J 2/04543* (2013.01); *B41J 2/04545* (2013.01); *B41J 2/155* (2013.01); *B41J 29/02* (2013.01); *B41J 2202/17* (2013.01)

(58) Field of Classification Search

CPC . B41J 2/04542; B41J 2/04545; B41J 2/04543
See application file for complete search history.

(56) References Cited

U.S. PATENT DOCUMENTS

| | | | | |
|---|---|---|---|---|
| 2004/0070774 | A1 | 4/2004 | Ishibashi et al. | |
| 2008/0018701 | A1 | 1/2008 | Lee | |
| 2008/0068410 | A1* | 3/2008 | Arakawa | B41J 2/04521 347/11 |
| 2011/0273507 | A1* | 11/2011 | Yamato | B41J 2/04508 347/19 |

FOREIGN PATENT DOCUMENTS

| | | |
|---|---|---|
| JP | 05193127 | 8/1993 |
| JP | 09239971 | 9/1997 |
| JP | 2004230787 | 8/2004 |
| KR | 20080008896 | 1/2008 |

OTHER PUBLICATIONS

International Search Report for PCT/US2013/028448 dated Nov. 6, 2013.

* cited by examiner

*Primary Examiner* — Jason Uhlenhake
(74) *Attorney, Agent, or Firm* — Rathe Lindenbaum LLP

(57) ABSTRACT

An apparatus and method support a plurality of print head dies (24, 324, 524) on a print bar (22, 322, 522). The plurality of print head dies (24, 324, 524) comprise a print head die (24, 324, 524) having a circuit (26, 526) forming a series (28, 328) of information bits (30), wherein bit locations in the series (28, 328) are mapped to information type definitions based on a location of the print head die (24, 324, 524) on the print bar (22, 322, 522) relative to other print head dies (24, 324, 524) on the print bar (22, 322, 522).

15 Claims, 4 Drawing Sheets

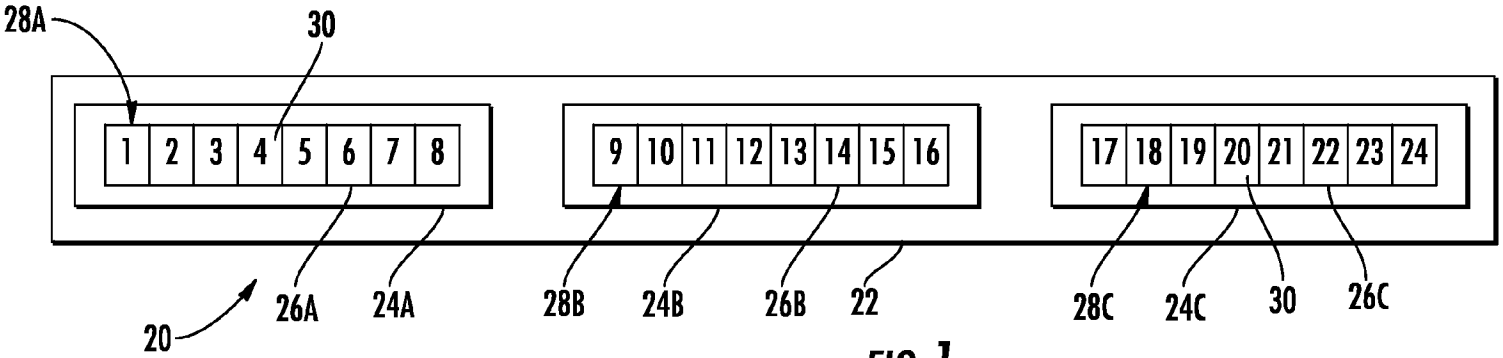
FIG. 1
| BIT LOCATION | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| INFORMATION TYPE | A | B | C | D | E | F | G | $H_1$ | $H_2$ | $H_3$ | $H_4$ | I | J | K | L | $M_1$ | $M_2$ | $M_3$ | $M_4$ | N | O | P | Q | R |
100
FIG. 2
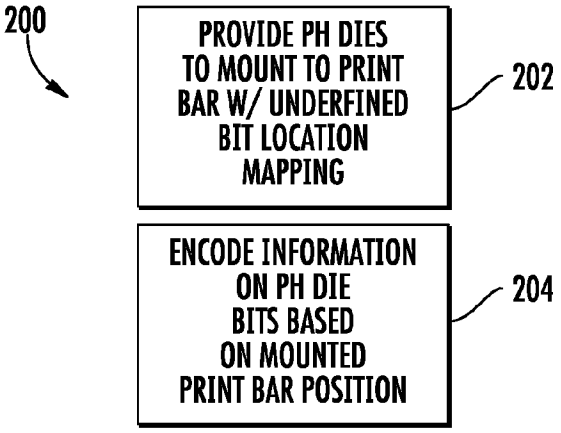
FIG. 3

| BIT LOCATION | 1 | 2 | 3 | 4 | 5 | 6 | 7 | 8 | 9 | 10 | ... | 53 | 54 | 55 | 56 | 57 | 58 | 59 | 60 | 61 | 62 | 63 | 64 |
|---|---|---|---|---|---|---|---|---|---|---|---|---|---|---|---|---|---|---|---|---|---|---|---|
| INFORMATION TYPE | $\Pi_1$ | $\Pi_2$ | A | B | C | D | E | $F_1$ | $F_2$ | $F_3$ | ... | AB | AC | AD | AE | AF | AG | AH | AI | AJ | AK | AL | AM |

402

| BIT LOCATION | 1 | 2 | 3 | 4 | 5 | 6 | 7 | 8 | 9 | 10 | ... | 53 | 54 | 55 | 56 | 57 | 58 | 59 | 60 | 61 | 62 | 63 | 64 |
|---|---|---|---|---|---|---|---|---|---|---|---|---|---|---|---|---|---|---|---|---|---|---|---|
| INFORMATION TYPE | $\Pi_1$ | $\Pi_2$ | B | C | D | E | $F_1$ | $F_2$ | $F_3$ | G | ... | AC | AD | AE | AF | AG | AH | AI | AJ | AK | AL | AM | A |

404

| BIT LOCATION | 1 | 2 | 3 | 4 | 5 | 6 | 7 | 8 | 9 | 10 | ... | 53 | 54 | 55 | 56 | 57 | 58 | 59 | 60 | 61 | 62 | 63 | 64 |
|---|---|---|---|---|---|---|---|---|---|---|---|---|---|---|---|---|---|---|---|---|---|---|---|
| INFORMATION TYPE | $\Pi_1$ | $\Pi_2$ | C | D | E | $F_1$ | $F_2$ | $F_3$ | G | H | ... | AD | AE | AF | AG | AH | AI | AJ | AK | AL | AM | A | B |

406

PRINT HEAD BIT INFORMATION MAPPING

BACKGROUND

Some printers include multiple print heads or print head dies on a single supporting body or print bar. To improve printer operation, each of the print head dies may include a circuit (26, 526) having a series of bits that is encoded in a predetermined order with identifying information. Corresponding bit locations on the different print head dies may be encoded with redundant information.

BRIEF DESCRIPTION OF THE DRAWINGS

FIG. 1 is a schematic diagram of an example print head array.

FIG. 2 is a diagram of an example bit location to information type template mapping for the print head array of FIG. 1.

FIG. 3 is a flow diagram of an example method for forming the print head array of FIG. 1.

DETAILED DESCRIPTION OF THE EXAMPLE EMBODIMENTS

Figure 4:
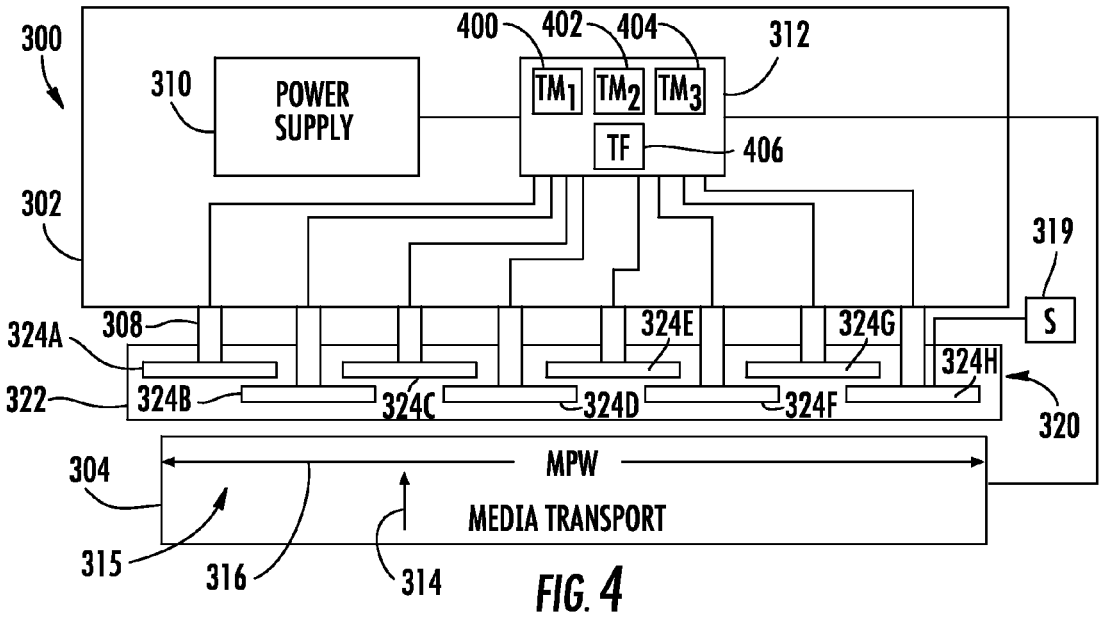
FIG. 4 is a schematic diagram of an example printer.

FIG. 1 schematically illustrates an example print head array 20 for use in a printer. As will be described hereafter, print head array 20 utilizes an information encoding or a bit mapping scheme that reduces or avoids the occurrence of redundant information on different print head dies. As a result, print head array 20 facilitates the provision of a greater amount of identification information or reduces the total number of bits utilized for information to consume less silicon area and reduce print head cost.

Print head array 20 comprises print bar 22 and print heads or print head dies 24A, 24B, 24C (collectively referred to as print heads 24). Print bar 22 comprises a body which supports print head dies 24. Although print bar 22 is illustrated as supporting three print head dies 24, in other implementations, print bar 22 may support two print head dies 24 or greater than three print head dies 24. Although print bar 22 is illustrated as supporting such print head dies 24 in an end-to-end arrangement, in other implementations, print bar 22 may support print head dies 24 in a staggered offset relationship or in a staggered partially overlapping relationship. In one implementation, print bar 22 supports print head dies 24 in a page-wide-array, wherein print head dies 24, collectively, span substantially across an entire width of the print medium.

Print head dies 24 selectively eject fluid or liquid, such as ink, onto an opposite print medium through one or more nozzles. In one implementation, print head dies 24 are each fluidly connected to a single fluid source or multiple fluid sources, wherein print head dies 24 each eject a same fluid (a fluid having substantial identical characteristics). For example, in one implementation, each of print head dies 24 may be connected to a single fluid source or multiple fluid sources so as to selectively eject a same color of ink In one implementation, print head dies 24 each comprise a thermal resistive inkjet die. In another implementation, print head dies 24 each comprise a piezo resistive inkjet die. In yet other implementations, print head dies 24 may comprise other drop-on-demand ink jetting devices for printing.

As schematically shown by FIG. 1, print head dies 24 each comprise a circuit forming a series of information bits. In the example illustrated, print head die 24A comprises a circuit 26A having a series 28A of information bits 30 at locations 1-8. Print head die 24B comprises a circuit 26B having a series 28B of information bits 30 at locations 9-16. Print head die 24C comprises a circuit 26C having a series 28C of information bits 30 at locations 17-24. Although each of print head dies 24 is illustrated as comprising a series of eight bits, in other implementations, each of print head dies 24 may include a series of other numbers of bits. For example, in another implementation, each of print head dies 24 may include a series of 64 bits. In the example illustrated, each of the bit locations 1-24 is dynamically mapped to an information type or information type definition based on a location of the particular print head die 24 on print bar 22 relative to the other print head dies 24. In other words, rearrangement of dies 24 on print bar 22 would result in bit locations being mapped to different types of identifying information.

Examples of different information or types of information that may be encoded onto one of more bit locations of print head dies 24 include information pertaining to the individual die itself and information pertaining to the print head array 20. Examples of information pertaining to the individual print head die itself include, but are not limited to, a manufacturing lot of the die, a manufacturing wafer number of the die, wafer location of the die and row/column information, temperature calibration parameters, energy parameters, or drop weight parameters for the die. Examples of information pertaining to print head array 20 itself (information that is not limited to specific characteristics of the particular die) include, but are not limited to, calibration info such as drop weight, energy, resistance values, and orifice sizes, or general information such as an ink usage, warranty information, the manufacturing site of the print head array, a rework status of the print head array and the like. Information may be encoded at either the die level or the bar level. For example, information regarding drop weight calibration for each die may be encoded to improve print quality or information regarding drop weight calibration across the entire bar may be encoded to ensure the correct number of printed pages are delivered.

FIG. 2 schematically illustrates an example mapping template or template map 100 which maps the bit locations of dies 24 to information types or information definitions. As shown by FIG. 2, each of the bit locations of dies 24 is assigned to a particular information type (arbitrarily designated as A-R). Although bit locations 1-8 of series 26A of print head die 24A correspond to the eight bit locations 9-16 of series 26B of print head die 24B, respectively, and the eight bit locations 17-24 of series 26C of print head die 24C, respectively, such corresponding bit locations in each series 26 are encoded with a different type of information. For example, bit location 4 of series 26A of print head 24A corresponds to bit location 12 of series 26B of print head 24B, yet bit location 4 is mapped to information type D while bit location 12 is mapped to a different information type I. In other words, the corresponding bit locations of different dies contain different types of data. Because such mapping treats the available bit locations provided by the different print head dies 24 as an aggregate collection of available bit locations, the mapping or encoding scheme efficiently utilizes the total available number of bit locations, reducing occurrences of unused/dead bit locations or bit locations on different print head dies 24 containing redundant information.

In one implementation, mapping template 100 may map bit locations on one of print head dies 24 to information types that are relevant to, identify or provide information pertaining to another one of print head dies 24. As shown by FIG. 2, in some implementations, one type and piece of information (information type H) may consume multiple bit locations, wherein the one piece of information is mapped to multiple bit locations that span, extend across or are located amongst multiple print head dies 24. In the example, one piece of information H is identified are defined by four bits 30 at bit location 8 on print head die 24A and bit locations 9, 10 and 11 on print head die 24B. In other implementations, such multi-bit information types may utilize a greater or fewer number of such bit locations. In other implementations, such multi-bit information types may utilize bit locations on multiple dies, wherein the designated bit locations for the multi-bit information type are not consecutive across adjacent or consecutive print head dies 24.

FIG. 3 is a flow diagram of an example method 204 forming a print head array, such as print head array 20. As indicated by step 202, print head dies 24 are initially provided for mounting to print bar 22. Such print head dies 24 each have an undefined mapping of bit locations to information types prior to being mounted to print bar 22. In other words, at least some of the bit locations of print head dies 24 are not yet assigned for storing and subsequently identifying any particular type of information.

As indicated by step 204, information is encoded at the bit locations of each of print head dies 24 based upon the relative mounting position of the individual print head die on print bar 22. In one implementation, values for different information types is encoded at the corresponding or mapped bit locations after the print head dies 24 have been mounted to print bar 22. Once mounted to print bar 22, the relative positioning of the print head dies 24 and their bit locations is known and set with regard to mapping template 100 such that information may be encoded onto the print head dies. In another implementation, values for different information types may be encoded at the corresponding or mapped bit locations prior to mounting of the print head dies to the print bar 22, but after determination or designation of the relative future locations or positions of the print head dies 24 on print bar 22.

FIG. 4 schematically illustrates an example printer 300 utilizing the information encoding or a bit mapping scheme described above with respect to FIGS. 1-2 and implemented per the method 200 of FIG. 3. Printer 300 comprises a main control system 302, media transport 304, electrical interconnects 308 and a print head array 320 (shown as a page wide array). Main control system 22 comprises an arrangement of components to supply electrical power and electrical control signals to print head array 320. Main control system 304 comprises power supply 310 and controller 312. Power supply 310 comprises a supply of high voltage.

Controller 312 comprises one or more processing units and/or one or more electronic circuits configured to control and distribute energy and electrical control signals to print head array 320. Energy distributed by controller 312 may be used to energize firing resisters to vaporize and eject drops of printing liquid, such as ink. Electrical signals distributed by controller 312 control the timing of the firing of such drops of liquid. Controller 312 further generates control signals controlling media transport 304 to position media opposite to print head array 320. By controlling the positioning a media opposite to print head array 320 and by controlling the timing at which drops of liquid are eject or fired, controller 312 generates patterns or images upon the print media.

Figures 5, 6:
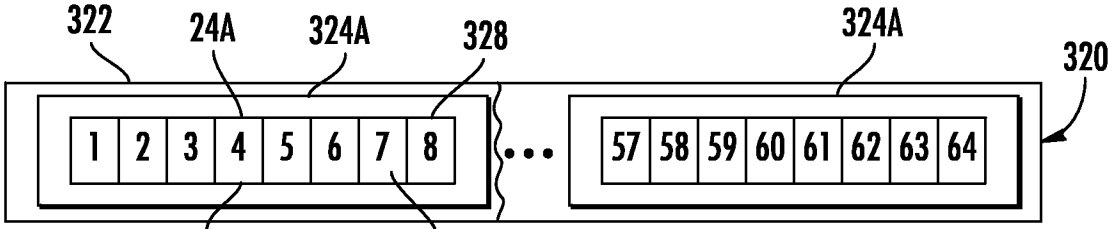
FIG. 5 is a schematic diagram of an example print head array of the printer of FIG. 4.
FIG. 6 is a schematic diagram of possible template mappings for the print head array of FIG. 5 which are stored on a controller of the printer of FIG. 4.

As shown by FIG. 4, controller 312 comprises possible template mappings 400, 402, 404 and template finder 406. Template mappings 400, 402 and 404 each comprise a different possible mapping of bit locations to information types. FIG. 6 diagrams the possible template mappings 402, 404 and 406 stored in a memory of or otherwise provided as part of controller 312.

Template finder 406 comprises programming or circuitry of controller 312 configured to locate and read one or more predefined bit locations on print head array 320 that indicate which of the plurality of different mappings 400, 402, 404 is being used on print head array 320. In one implementation, the same bit locations on the print head array contain the template mapping identifier regardless of the mapping employed on the print head array. As will be described hereafter, this arrangement enhances security to inhibit counterfeiting and provides flexibility to accommodate future system changes. Although controller 212 is illustrated as comprising three possible template mappings, in other implementations, controller 312 may include a fewer or greater of such possible template mappings. In some implementations, controller 312 may include a single template mapping which maps bit locations to information types in the print head array 320.

Media transport 304 comprises a mechanism configured to position a print medium with respect to print head array 320. In one implementation, media transport 304 may comprise a series of rollers to drive a sheet of media or a web of media opposite to print head array 320. In another implementation, media transport 304 may comprise a drum about which a sheet or a web of print media is supported while being carried opposite to print head array 320. As shown by FIG. 4, media transport 304 moves print medium in a direction 314 along a media path 315 having a width 316. The width 316 is generally the largest dimension of print media that may be moved along the media path 315.

Page wide array 320 comprises support, body or print bar 322, printing liquid supplies 319 and print head dies 324A, 324B, 324C, 324D, 324E, 324F, 324G and 324H (collectively referred to as print head dies 324). Print bar 322 comprises one or more structures that retain, position and support print head dies 324 in a staggered, overlapping fashion across width 316 of media path 315. In the example implementation, print bar 322 staggers and overlaps print head dies 324 such that an entire desired printing width or span of the media being moved by media transport 314 may be print head in a single pass or in fewer passes of the media with respect to print head die 322.

Printing liquid supplies 319, one of which is schematically shown in FIG. 4, comprise reservoirs of printing liquid. Supplies 319 are fluidly connected to each of dies 324 so as to supply printing liquid to dies 324. In one implementation, printing liquid supplies 319 supply multiple colors of ink to each of print head dies 324. For example, in one implementation, printing liquid supply 319 supplies cyan, magenta, yellow and black inks to each of dies 324. In one implementation, printing liquid supplies 319 are supported proximate to and above print bar 322. In another implementation, printing liquid supplies 319 comprise off-axis supplies.

Interconnects 308 comprise structures for supporting or carrying electrically conductive lines or traces to transmit electrical energy (electrical power for firing resisters and electrical signals or controlled voltages to actuate the supply of the electrical power to the firing resisters) from controller 312 to the firing actuators of the associated print head die 324.

In other implementations, interconnects 308 may have other configurations to supply a lexical power to each of print head dies 324.

Print head dies 324 comprise individual structures by which nozzles and liquid firing actuators are provided for ejecting drops of printing liquid, such as ink Each print head die 324 is similar to print head dies 24 described above. FIG. 5 schematically illustrates print head array 320 and two of its endmost print head dies 324A and 324H. As shown by FIG. 5, like print head dies 24, each of print head dies 324 comprises a circuit 26 forming a series 28 of bits 30 (described above). Print head dies 324 are similar to print head dies 24 in that each die 324 is illustrated as including a series of eight bits 30. Collectively, the eight print head dies 324 of print head array 320 provide 64 bit locations.

Similar to the bit locations of print head array 22, the 64 bit locations collectively provided by dies 324 are each dynamically mapped to an information type or information type definition based on a location of the particular print head die 324 on print bar 322 relative to the other print head dies 324. In other words, rearrangement of dies 324 on print bar 322 would result in the same bit locations on individual dies being mapped to different types of identifying information. Similar to print head dies 24, corresponding bit locations in each series 28 may be encoded with a different type of information. In other words, the corresponding bit locations of different dies contain different types of data. Because such mapping treats the available bit locations provided by the different print head dies 324 as an aggregate collection of available bit locations, the mapping or encoding scheme efficiently utilizes the total available number of bit locations, reducing occurrences of unused bit locations or bit locations on different print head dies 324 containing redundant information.

In one implementation, bit locations on one of print head dies 324 may be mapped to information types that are relevant to, identify or provide information pertaining to another one of print head dies 324. Moreover, as shown by FIG. 6, in some implementations, one type and piece of information (information type F) may consume multiple bit locations, wherein the one piece of information is mapped to multiple bit locations that span, extend across or are located amongst multiple print head dies 324.

Similar to print head dies 24, the individual dies 324 each have an undefined mapping of bit locations to information types prior to being mounted to print bar 22. In other words, at least some of the bit locations of print head dies 324 are not yet assigned for storing and subsequently identifying any particular type of information. However, once print head dies 324 are either mounted to print bar 322 or have been assigned to particular designated locations on print bar 322 and relative positions with respect to the other print head dies 324, information is encoded at the bit locations of each of print head dies 324 based upon the relative mounting position of the individual print head die on print bar 322.

As shown by FIG. 6, in the example illustrated, regardless of the mapping scheme employed for print head array 320, the first two bit locations (1 and 2) of the collective series of bit locations provided by print head dies 324 is designated or mapped to information identifying which of the mapping schemes are template mappings 400, 402 or 404 is employed on the print head array 320. Template Finder 406 (described above) automatically reads the predefined bit locations (1 and 2) to identify which of the three possible template mappings is employed and then proceeds to map to the rest of the bit locations using the identified template mapping. In other words, once template finder 406 has identified the particular template mapping 400, 402, 404 being used on the particular print head array 320, controller 312 will utilize the identified template mapping to locate and read information from print head array 320. For example, during calibration of print head array 320, controller 312 may utilize drop weight information contained on print head array 320. To locate such information, controller 312 will consult the identified template mapping to determine which bit location(s) should be read for such information.

Figure 7:
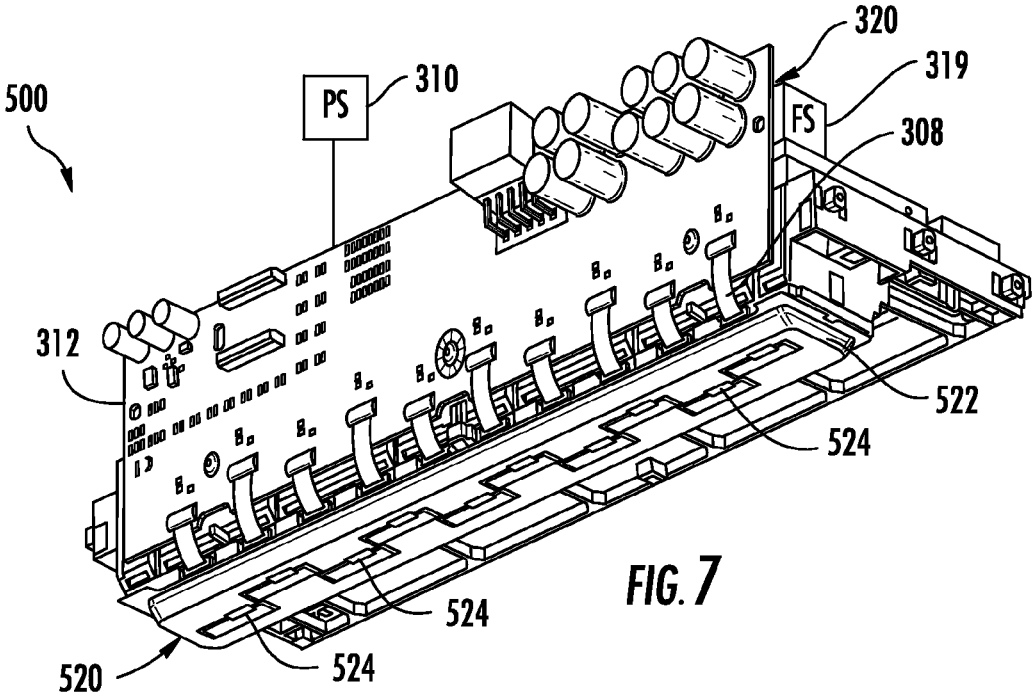
FIG. 7 is a bottom perspective view of an example implementation of the printer of FIG. 4.
Figure 8:
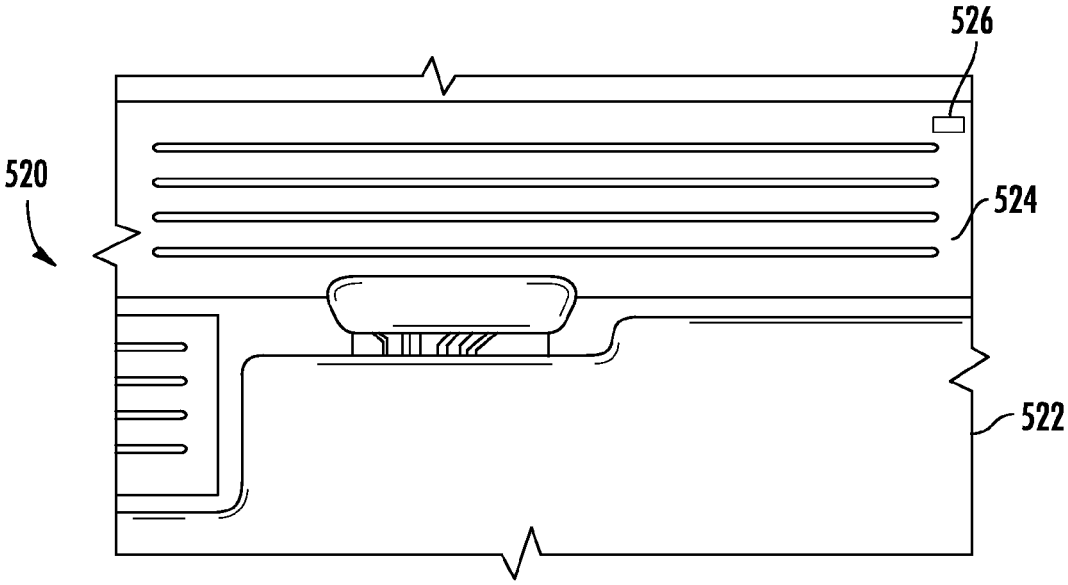
FIG. 8 is an enlarged bottom view of a portion of a print head array of the printer of FIG. 7.

FIGS. 7 and 8 illustrate printing system 500, an example implementation of printing system 300. FIG. 7 is a bottom perspective view of a portion of printing system 500. FIG. 8 is an enlarged bottom view of one of the print head dies. Printing system 500 is similar to printing system 300 except that printing system 500 includes print head array 520 in lieu of print head array 320. Print head array 520 is itself similar to print head array 320 except that print head array 520 comprises 10 (rather than eight) print head dies 524. Each print head die 524 (one of which is shown in FIG. 8) comprises a circuit 526 forming a series of bits that respective bit locations. Each circuit 526 is similar to circuit 26 except that each circuit 526 forms a series of 64 bits. As a result, the 10 print head dies 524 of print head array 520 collectively provide 640 bits or 640 bit locations. Those remaining components of printer 500 which correspond to components of printer 300 are numbered similarly.

Similar to print head dies 24 and 324, the individual dies 524 each have an undefined mapping of bit locations to information types prior to being mounted to print bar 522. In other words, at least some of the bit locations of print head dies 524 are not yet assigned for storing and subsequently identifying any particular type of information. However, once print head dies 524 are either mounted to print bar 522 or have been assigned to particular designated locations on print bar 522 and relative positions with respect to the other print head dies 524, information is encoded at the bit locations of each of print head dies 524 based upon the relative mounting position of the individual print head die on print bar 522.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a print bar (22, 322, 522);

a plurality of print head dies (24, 324, 524) supported by the print bar (22, 322, 522), the plurality of print head dies (24, 324, 524) comprising a first print head die (24, 324, 524) having a first circuit (26, 526) forming a first series (28, 328) of information bits (30), wherein bit locations in the first series (28, 328) are dynamically mapped to information type definitions based on a location of the first print head die (24, 324, 524) on the print bar (22, 322, 522) relative to other print head dies (24, 324, 524) of the plurality of print head dies (24, 324, 524).

2. The apparatus of claim 1, wherein the plurality of print head dies (24, 324, 524) comprises a second print head die (24, 324, 524) to eject a same fluid as the first print head die, the second print head die (24, 324, 524) having a second circuit (26, 526) forming a second series (28, 328) of information bits (30), the second series (28, 328) of s information bits (30) being encoded with information pertaining to the first print head die (24, 324, 524).

3. The apparatus of claim 2, wherein the same fluid comprises a same color of ink.

4. The apparatus of claim 1, wherein the plurality print head dies (24, 324, 524) comprises six print head dies (24, 324, 524) including the first print head die, each of the six print head dies (24, 324, 524) to eject a same fluid, wherein each of the six print head dies (24, 324, 524) has a series (28, 328) of information bits (30) and wherein a same bit location in each of the series (28, 328) is encoded with a different type of information.

5. The apparatus of claim 1, wherein a single piece of information is defined by information bits (30) spread across the plurality of print head dies (24, 324, 524).

6. The apparatus of claim 1 further comprising a printer (300, 500) comprising a controller (312) and including the print bar (22, 322, 522) with the plurality of dies (24, 324, 524), wherein the controller (312) stores a template (400, 402, 404) mapping bit locations across all of the plurality of dies (24, 324, 524) to information type definitions.

7. The apparatus of claim 6, wherein the controller (312) stores a plurality of possible templates (400, 402, 404).

8. The apparatus of claim 7, wherein the information bits (30) indicate which of the plurality of templates (400, 402, 404) maps the bit locations to the information type definitions.

9. An apparatus comprising:

a body (22, 322, 522);

a first print head die (24, 324, 524) supported by the body (22, 322, 522) to eject a color of ink, the first print head die (24, 324, 524) comprising a first circuit (26, 526) forming a first series (28, 328) of information bits (30) encoded according to a first mapping (400, 402, 404) of bit locations to information types; and a second print head dies (24, 324, 524) supported by the body (22, 322, 522) to eject the color of ink, the second print head die (24, 324, 524) comprising a second circuit (26, 526) forming a second series (28, 328) of information bits (30) encoded according to a second mapping (400, 402, 404) of bit locations to information types different than the first mapping.

10. The apparatus of claim 9, wherein the second series (28, 328) of information bits (30) is encoded with information pertaining to the first print head die (24, 324, 524).

11. The apparatus of claim 9, wherein a same bit location in each of the series (28, 328) is encoded with a different type of information.

12. A method comprising:

mounting a plurality of print head dies (24, 324, 524) to a print bar (22, 322, 522), each of the plurality of print head dies (24, 324, 524) having a circuit (26, 526) forming a series (28, 328) of information bits (30), the series (28, 328) of information bits (30) on each die (24, 324, 524) being having an undefined mapping of bit locations to information types prior to being mounted to the print bar (22, 322, 522); and encoding information on the information bits (30) of the plurality of dies (24, 324, 524) based upon the relative mounted position on the print bar (22, 322, 522).

13. The method of claim 12, wherein the plurality of print head dies (24, 324, 524) are to eject a same color of ink and wherein the encoding of information on the information bits (30) comprises encoding information regarding a first one of the plurality of print head dies (24, 324, 524) on a second one of the plurality of print head dies (24, 324, 524).

14. The apparatus of claim 12, wherein a same bit location in each of the series (28, 328) is encoded with a different type of information.

15. The method of claim 12 further comprising:

storing a plurality of different mappings (400, 402, 404) of bit locations to information type definitions for the information bits (30) of the plurality of dies (24, 324, 524); and encoding the information bits (30) of the plurality of dies (24, 324, 524) with information indicating which of the plurality of different mappings (400, 402, 404) is used on the plurality of dies (24, 324, 524).

* * * * *